United States Patent [19]

Kisling, III

[11] 3,998,280

[45] Dec. 21, 1976

[54] WAVE MOTION COMPENSATING AND DRILL STRING DRIVE APPARATUS

[75] Inventor: James W. Kisling, III, Houston, Tex.

[73] Assignee: Schlumberger Technology Corporation, New York, N.Y.

[22] Filed: Sept. 4, 1973

[21] Appl. No.: 394,040

[52] U.S. Cl. ..... 175/5; 175/27; 173/149

[51] Int. Cl.[2] ..... E21B 7/12

[58] Field of Search ..... 175/321, 195, 203, 27, 175/5; 173/148–150; 64/23, 23.5, 23.6

[56] References Cited

UNITED STATES PATENTS

| | | | |
|---|---|---|---|
| 1,971,922 | 8/1934 | Smith | 175/103 X |
| 2,007,666 | 7/1935 | Smith | 175/321 X |
| 2,598,203 | 5/1952 | Acker | 173/150 |
| 2,838,283 | 6/1958 | Simmonds | 175/321 |
| 2,945,677 | 7/1960 | Kammerer | 175/203 X |
| 3,421,581 | 1/1969 | Geijn | 175/5 X |
| 3,653,635 | 4/1972 | Bates | 175/5 |
| 3,768,578 | 10/1973 | Russell | 175/321 X |
| 3,917,006 | 11/1975 | Kellner | 175/5 |
| R27,261 | 12/1971 | Bromell et al. | 175/7 X |

*Primary Examiner*—James A. Leppink
*Assistant Examiner*—Richard E. Favreau
*Attorney, Agent, or Firm*—David L. Moseley; William R. Sherman; Stewart F. Moore

[57] ABSTRACT

A wave motion compensating and drill string drive apparatus for use in connection with offshore drilling operations includes a kelley with a mandrel telescopically disposed therein and providing a hydraulic ram whose working volume is supplied with fluid at a preselected pressure such that a constant weight can be imposed by the drill string on the bit as the vessel undergoes vertical motion. The hydraulic fluid is supplied to the ram via a swivel coupling to enable the kelley and mandrel to rotate relative thereto, and the members are coupled by slidable splines for the transmission of torque from the rotary to the drill string.

8 Claims, 4 Drawing Figures

WAVE MOTION COMPENSATING AND DRILL STRING DRIVE APPARATUS

This invention relates in general to a device for supporting tubular strings of drill pipe, casing or tubing in well bores, and particularly to a hydraulically operated suspension apparatus that is effective to maintain the weight imposed by a drill string on a drill bit substantially constant even though the drilling vessel is subject to vertical motion as a result of wave action, tides and the like.

In order to compensate for the heave of a floating drilling vessel during drilling operations, so that upward movement does not raise the drill string in the well bore nor does downward movement lower it, it is typical practice to utilize a hydraulic ram that has a piston and a cylinder with one member carrying the drilling load and the other member transmitting the load to the derrick. If a substantially constant fluid pressure is maintained within the working volume of the ram, the drill string can remain stationary with respect to the seabed while the derrick moves vertically. In this manner, a constant weight can be imposed by the drill string on the bit at all times.

The hydraulic ram assemblies of the prior art have been positioned primarily in one of two locations in the derrick, either at the crown block as shown for example in U.S. Pat. No. 3,151,686, or at the traveling block as shown in U.S. Pat. No. 2,945,676. However, location at the crown block requires construction of a special derrick in view of extra height requirements and the possibility of higher dynamic forces, whereas location at the traveling block increases the possibility of damage because a large amount of rather massive and complex hardware hangs more or less unprotected in the derrick. Moreover, time consuming and expensive rig up and down time is required for installation as well as any repair or reconditioning work that may be required during the course of a well drilling operation.

It is the principle object of this invention to provide a new and improved hydraulically operated wave heave compensator of the type discussed above that does not require modification of existing equipment.

A further object is to provide a new and improved wave heave compensator that is readily installed in, and removed from, the drill string with a minimum of cost and inconvenience.

Yet another object of the present invention is to provide a new and improved wave motion compensator that also functions as a drill string drive member or kelley and thus does not require extensive modification or addition to equipment otherwise essential to rotary drilling operations.

These and other objects are attained in accordance with the concepts of the present invention through the provision of an apparatus having an inner member that is slidable within an outer member, one of which is connected to a suspension device in the derrick and the other to the drill string. The members define piston and cylinder means that receive and exhaust hydraulic fluid under constant pressures during sliding movement to thereby maintain a predetermined stress in the running-in string. The outer one of the members is provided with a polygonal cross-sectional outline and is thus arranged to be driven by the rotary of the drilling rig, and a slidable spline connection is provided to transmit torque from one member to the other and to the drill string so that the apparatus of the present invention also functions as the kelley during the drilling operation. The hydraulic fluid connection to the piston and cylinder is made via a rotatable coupling on one member to enable the device to spin relative to the hydraulic lines. In sum, the present invention provides a combination wave motion or heave compensator and kelley that obviates any requirement for special derrick construction, as well as requirements for special handling and installation.

The present invention has other objects and advantages that will become more clearly apparent in connection with the following detailed description of several embodiments thereof, taken in conjunction with the appended drawings in which.

Figure 1:
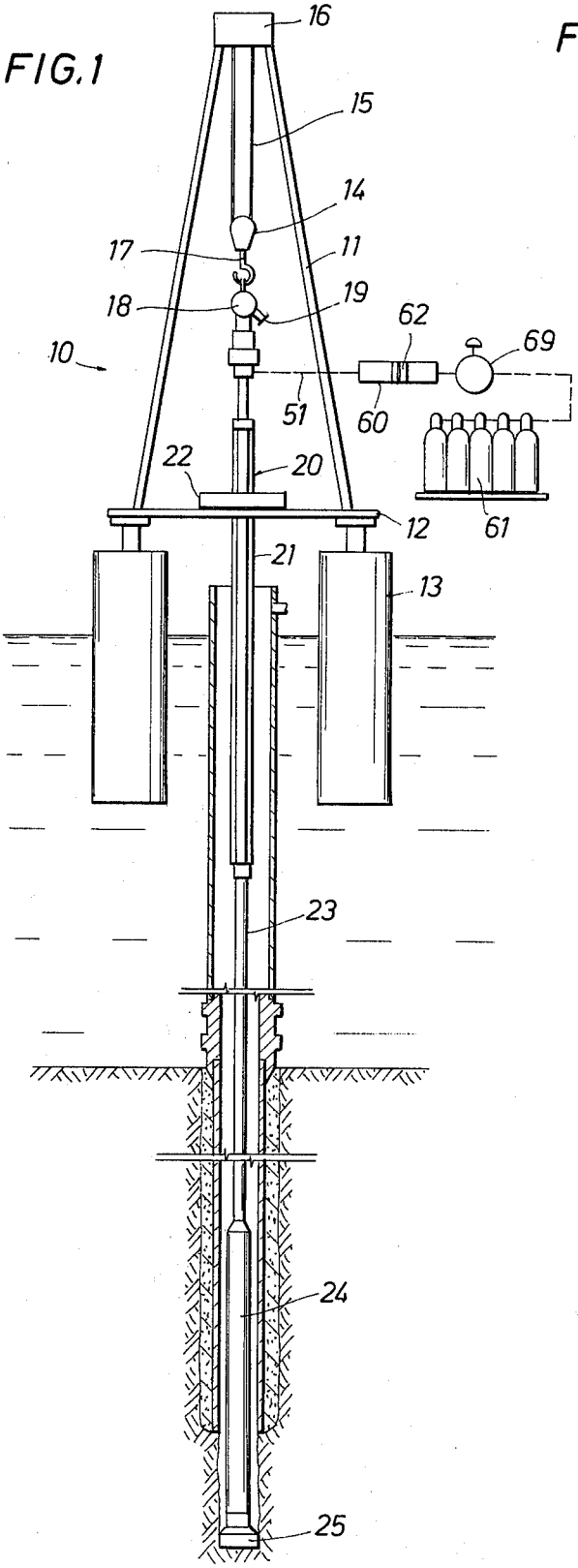
FIG. 1 is a view of an offshore well drilling operation being conducted from a floating vessel and utilizing a wave motion compensator and drill string drive apparatus in accordance with this invention.

Referring initially to FIG. 1, a floating drilling vessel 10 of conventional construction includes an upstanding derrick 11 that a mounted on a working deck 12 which is buoyantly supported in the water by a plurality of flotation columns 13. Of course the vessel 10 is moored or otherwise stationed over a subsea well that is being drilled by typical rotary drilling techniques. A traveling block 14 is suspended by cable 15 from a crown block 16, and carries a hook 17 that suspends a swivel assembly 18 having an inlet connection 19 for the supply of drilling muds. The cable 15 is wound on a drawworks (not shown) by which the traveling block 14 and the swivel assembly 18 are raised and lowered in the derrick.

The swivel assembly 18 is connected to the upper end of a wave motion compensator and drill string drive apparatus 20 that is constructed in accordance with the principles of the present invention. As will appear in greater detail herebelow, the apparatus 20 includes an elongated housing 21 that is extended through the rotary table 22 and provided with a polygonal cross-section, so that the housing 21 is turned by the rotary 22 which is driven through suitable gearing and transmission by diesel engines or the like. The drill pipe 23 is connected to the lower end of the apparatus 20 and extends downwardly into the borehole where it normally is connected to a length of drill collars 24 having a drill bit 25 attached to their lower end. The drill collars provide the necessary weight on the bit so that it will cut through the rock as it is turned. Drilling muds are circulated under pressure down through the drill string and bit and return to the surface via the well annulus, carrying cuttings to the surface and lubricating and cooling the bit.

Figure 2:
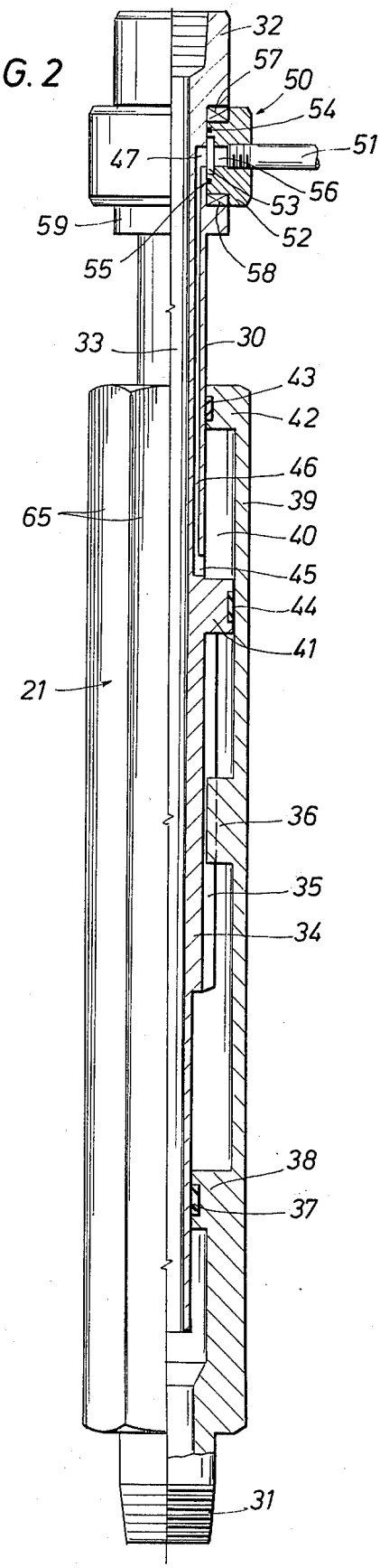
FIG. 2 is a somewhat schematic view of one embodiment of the compensator and drive apparatus.

Inasmuch as the vessel 10 will undergo vertical upward and downward motion under the influence of wave and tide action, it is desirable to provide a means for compensating such motion in such a manner that the drill string 23 does not move with the vessel. In this manner a substantially constant weight can be applied to the drill bit for efficient drilling operations. One embodiment of a motion compensating apparatus 20 is shown somewhat schematically in FIG. 2, with the various parts being foreshortened for ease of illustration. Of course it will be recognized, however, that the assembly will normally be 55–60 feet long. As shown, the elongated housing 21 has an inner member or mandrel 30 slidably received therein, with the lower end of the housing having a threaded pin 31 adapted for connection to the drill string 23. The upper end of the mandrel 30 has a threaded box 32 for connection with the swivel assembly 18, and a central open bore 33 that provides a flow path for the drilling fluids. A lower portion 34 of the mandrel 30 is formed with longitudinally extending spline grooves 35 that mesh with inwardly extending splines 36 on the housing 21 in order to corotatively couple the members together. If desired, a seal ring 37 can be arranged on an inwardly directed shoulder 38 to slidably engage the mandrel 30 in order to prevent entry between the members of any debris laden fluids.

The upper portion 39 of the housing 21 is arranged to provide an annular cylinder space 40 between an outwardly directed flange or piston 41 on the mandrel 30 and an inwardly directed flange or piston 42 at the upper end of the housing. The cylinder space 40 is sealed off at its opposite ends by suitable packing rings 43 and 44, and one or more lateral ports 45 communicate the space with a flow course 46 that extends upwardly through the mandrel 30 externally of the bore 33. Near the upper end of the mandrel 30, one or more side ports 47 are provided to bring the fluid passage to the outside. A swivel connection indicated generally at 50 for a control fluid line 51 includes a ring 52 having an internal annular recess 53 and carrying seal rings 54 and 55 above and below the side ports 47, with a flow port 56 intersecting the recess. To facilitate relative rotation between the ring 52 and the mandrel 30, suitable bearings 57 and 58 can be provided with the lower bearing being disposed above a shoulder 59 and the upper bearing being retained against the lower face of the threaded box 32. The hydraulic line 51 is connected with the port 56 for the supply and reception of fluid to and from the cylinder space 40 as the mandrel 30 moves vertically relative to the housing 21. In actual practice, it will be appreciated that the splines 35, 36 and the chamber 40 are arranged and sized such that relative longitudinal motion in the order of about 15 feet, for example, is permitted to accommodate vertical motion of the vessel 10 in that order of magnitude.

As shown schematically in FIG. 1, the line 51 leads to an accumulator system located onboard the vessel 10 that includes an expansion cylinder 60 together with a pressurized gas reservoir 61 of substantial volume. The function of the accumulator system is to supply or receive, upon demand, hydraulic fluid under a wide range of volume and pressure requirements. To this end, the expansion cylinder 60 has a diaphragm or pistion 62 movably disposed therein, with hydraulic fluid on the line side and a compressible medium, such as nitrogen gas, on the other side. A pressure regulator valve 63 located between the reservoir 61 and the cylinder 60 can be adjusted to ensure a substantially constant, selected pressure in the system. This pressure is transmitted via the piston 62 to the fluid in the line 51 which, in turn, feeds the pressure through the swivel coupling 50 and the flow passage 46 into the cylinder space 40. The pressure within the cylinder space 40 acts upwardly on the housing piston 42 and downwardly on the mandrel piston 41, so that the stress in the housing 21 due to the weight of the drill string 23 is transferred by the pressurized fluid to the mandrel 30 which is suspended in the derrick 11.

In operation, fluids under substantially constant pressure are supplied to the cylinder space 40 as the vessel 10 moves downwardly relative to the ocean floor under the influence of wave action, and are exhausted back into the expansion cylinder 60 as the vessel moves upwardly. The pressure is maintained at a predetermined value, depending upon the adjustment of the regulator valve 63, to ensure the maintenance of the desired net drilling weight on the bit 25. As the bit advances, the drill string 23 will gradually move downwardly, carrying the housing 21 downwardly along with the mandrel 30 as the traveling block 14 is lowered within the derrick 11. The outer flats 65 (FIG. 2) on the housing 21 are engaged and driven by the bushings on the rotary table 22, and the splines 35 and 36 transmit the rotation to the drill string 23 to turn it and the bit 25. The swivel coupling 50 remains stationary relative to the turning mandrel 30, as hydraulic fluid is constantly being transferred to and from the cylinder space 40. Of course when an additional amount of footage of hole has been drilled corresponding substantially to the length of the housing 21, the drill string 23 is elevated and suspended in slips at the rotary table 22. The housing 21 is then disconnected so that an additional length of drill pipe can be inserted into the string, whereupon the housing is reconnected and engaged with the rotary table so that drilling can proceed. This phase of the procedure is standard practice in use of a kelley in drilling operations.

Thus it will be recognized that the present invention functions as both a motion compensator and a kelley for the drill string, and requires no modification whatever of the derrick for its installation. A minimum of hardware is positioned within the derrick as compared to prior traveling block installations, and the apparatus can be removed from one drilling vessel to another with maximum dispatch.

Figure 3A:
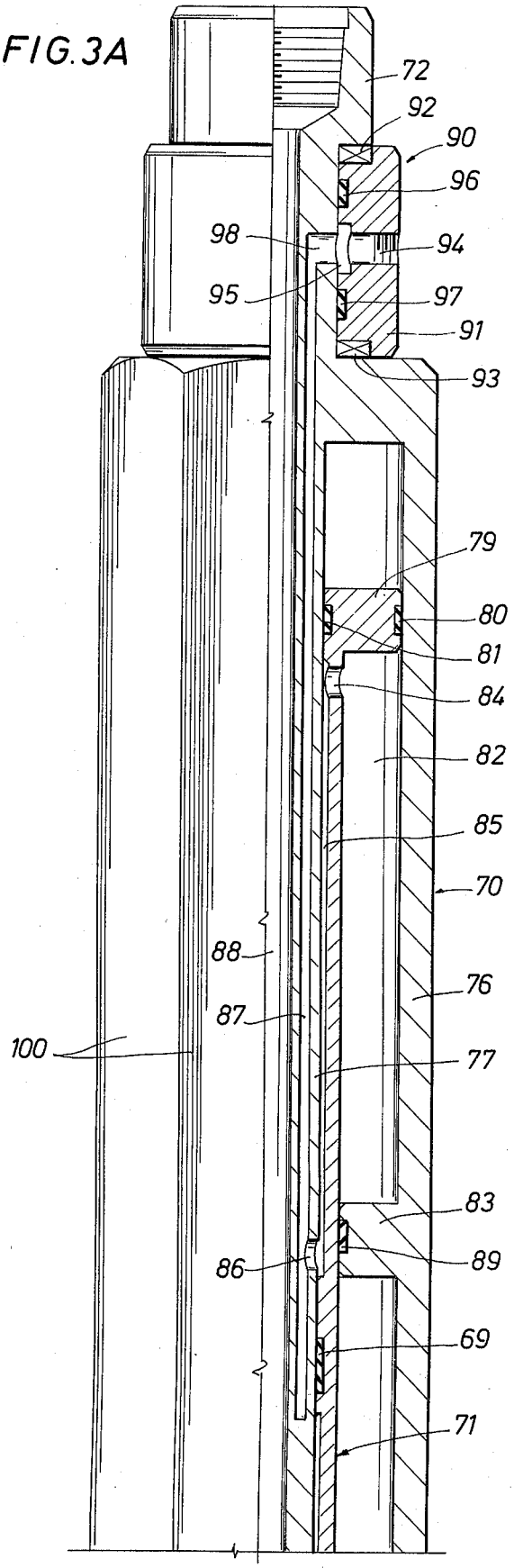
FIG. 3 is a view similar to FIG. 2 of another embodiment of the present invention.
Figure 3B:
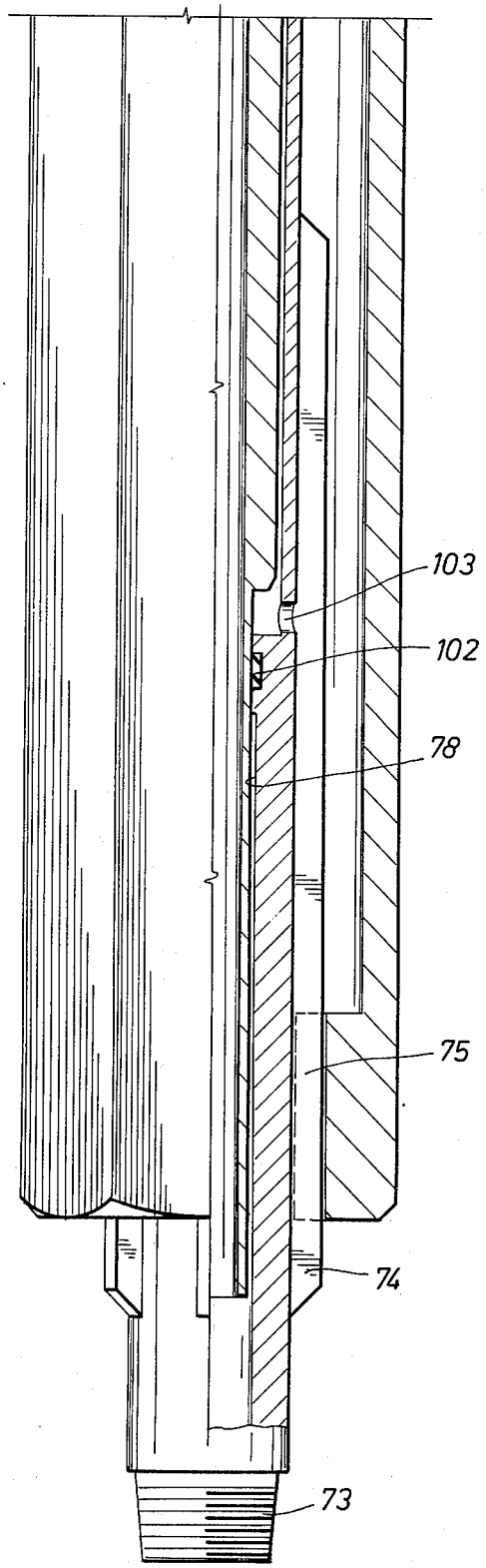

Another embodiment of the present invention is shown in FIGS. 3A and 3B as including an elongated housing 70 having a mandrel 71 extending upwardly within its lower end. A threaded box 72 is provided at the upper end of the housing 70 for connection to the swivel assembly 18, and a threaded pin 73 at the lower end of the mandrel 71 is arranged to be connected to the drill string 23. In order to prevent relative rotation of the members, a plurality of radially directed, elongated spline ribs 74 on the mandrel 71 are meshed with spline grooves 75 on the lower end of the housing 70.

The housing 70 is constituted by an outer tubular section 76 and a concentrically disposed inner section 77. The inner section 77 extends downwardly through the bore 78 of the mandrel 71 substantially throughout the length of the housing 70. An annular piston 79 on the upper end of the mandrel 71 is sealed with respect to the inner wall of the outer section 76 by a seal ring 80, and with respect to the outer wall of the inner section 77 by a seal ring 81. The annular space 82 below the piston 79 and above an inwardly extending flange or piston 83 on the outer housing section 76 provides a working cylinder into which hydraulic fluid is fed via ports 84 through the wall of the mandrel 71. The ports 84 connect with a passage 85 provided by an internal annular recess extending along the mandrel, which is connected by ports 86 to a flow course 87 that extends upwardly on the inner housing section 77 externally of the bore 88 therethrough. A seal ring 89 on the mandrel 71 below the passage 85 engages the outer surface of the inner housing section 77 to prevent leakage of hydraulic fluid.

A swivel coupling 90 is arranged in a manner similar to that described heretofore with respect to the first embodiment, and includes a ring 91 mounted on bearing 92 and 93 with a flow port 94 leading to an internal annular recess 95 having seal rings 96 and 97 above and below it. The recess 95 communicates with radial ports 98 that connects with the upper end of the flow course 87 in the housing section 77. A hydraulic line (not shown) is coupled with the port 95 to feed and receive hydraulic fluid respectively to and from the working chamber 82.

In operation, fluids under substantialy constant pressure are provided by the accumulator system previously described. Within the chamber 82, the pressure acts upwardly on the lower face of the mandrel piston 79 and downwardly on the upper face of the housing piston 83, so that stress in the mandrel 71 due to the weight of the drill string 23 is transferred to the housing 70 and by the hoist works to the derrick 11. Thus the chamber 82 will expand in volume during downward movement of the vessel 10, and decrease in volume during upward movement, in such a manner that a constant net weight can be applied to the drill bit 25. As drilling proceeds, the housing 70 and mandrel 71 are permitted to move downwardly together, with the outer flats 100 on the housing 70 being engaged by the rotary bushings as the entire assembly except for the swivel ring 91 is rotated by the rotary table 22. The empty space above the mandrel piston 79 can be vented to the outside by ports or the like, or can merely contain air at atmospheric or other low pressure. If desired, a seal ring 102 can be provided on the splined section of the mandrel 71 (FIG. 3B), with ports 103 to enable free liquid transfer during telescoping motion of the members.

Since certain changes or modifications may be made by those skilled in the art without departing from the inventive concepts disclosed herein, it is the aim of the appended claims to cover all such changes and modifications falling within the true spirit and scope of the present invention.

I claim:

1. A wave motion compensating and drill string drive apparatus comprising: an inner member telescopically received within an outer member, said members having piston and cylinder means adapted to receive and exhaust hydraulic fluid under pressure during relative longitudinal movement, one of said members having connecting means adapted for connection to a suspension device and the other of said members having connecting means adapted for connection to a drill string; means for transmitting torque applied to said outer member to said inner member; said outer member having a polygonal outline to provide a plurality of external drive surfaces arranged to be engaged by the rotary of a drilling rig; and a flow coupling assembly on said one member for connecting a source of hydraulic fluid to said piston and cylinder means, said assembly being constructed and arranged to enable rotation of said one member with respect thereto; said piston and cylinder means including a first piston on said inner member that is sealingly slidable against said outer member, and a second piston on said outer member that is sealingly slidable against said inner member above said first piston, and annular cylinder space being provided between said first and second pistons.

2. The apparatus of claim 1 wherein said inner member has a vertical bore therethrough to enable the circulation of well drilling fluids, and further including fluid passage means extending exteriorly of said bore from said flow coupling assembly to a location in communication with said cylinder space between said first and second pistons.

3. A wave motion compensating and drill string drive apparatus comprising: an inner member telescopically received within an outer member, said members having piston and cylinder means adapted to receive and exhaust hydraulic fluid under pressure during relative longitudinal movement, one of said members having connecting means adapted for connection to a suspension device and the other of said members having connecting means adapted for connection to a drill string; means for transmitting torque applied to said outer member to said inner member; said outer member having a polygonal outline to provide a plurality of external drive surfaces arranged to be engaged by the rotary of a drilling rig; a flow coupling assembly on said one member for connecting a source of hydraulic fluid to said piston and cylinder means, said assembly being constructed and arranged to enable rotation of said one member with respect thereto; said piston and cylinder means including a first piston on said inner member that is sealingly slidable against said outer member, and a second piston on said outer member that is sealingly slidable against said inner member below said first piston, an annular cylinder space being provided between said first and second pistons; a tubular member that is rigidly fixed to said outer member and extends downwardly within said inner member, said tubular member having a vertical bore therethrough to enable the circulation of drilling fluids; and fluid passage means extending in part within said tubular member exteriorly of said bore from said flow coupling assembly to a location in communication with said cylinder space between said first and second pistons.

4. The apparatus of claim 3 wherein said first piston is sealingly slidable against said tubular member, said fluid passage means extending in part between said inner member and said tubular member and including port means extending radially through said inner member adjacent and below said first piston.

5. A wave motion compensating and drill string drive apparatus comprising: a housing having a polygonal outline providing drive surfaces adapted to be engaged by the rotary of a drilling rig, said housing having means at its lower end adapted for connection to a drill string; a mandrel telescopically disposed within said housing and having means at its upper end adapted for connection to a suspension device; piston and cylinder means on said housing and said mandrel arranged to receive and exhaust hydraulic fluid under pressure during relative longitudinal movement, said piston and cylinder means including a first piston on said mandrel and a second piston on said housing, said first pistion being located below said second piston, so that hydraulic fluid between said pistons transfers stress on said housing to said mandrel; a fluid coupling having a swivel connection to said mandrel to enable rotation of said mandrel and said housing relative thereto; and a fluid flow course extending within said mandrel from said fluid coupling to a location between said first and second pistons.

6. The apparatus of claim 5 further including means for supplying hydraulic fluid to, and receiving hydraulic fluid from, said piston and cylinder means via said fluid coupling and flow course during said relative longitudinal movement, said hydraulic fluid being at a substantially constant pressure.

7. A wave motion compensating and drill string drive apparatus, comprising: an elongated housing having concentrically disposed inner and outer tubular portions, said outer portion having a polygonal outline providing drive surfaces adapted to be engaged by the rotary of a drilling rig; means at the upper end of said housing adapted for connection to a suspension device; a mandrel extending upwardly within the lower end of said housing and in between said inner and outer portions, said mandrel having means at its lower end adapted for connection to a drill string; means for transmitting torque applied to said housing to said mandrel to cause rotation of the drill string; first piston means on said outer portion of said housing sealingly slidable against said mandrel; second piston means on said mandrel sealingly slidable against said outer portion and said inner portion, said second piston means being spaced above said first piston means to provide a variable volume chamber; and means including a flow course extending in part within said inner portion and in part between said inner portion and said mandrel for supplying fluid under pressure to said chamber, said fluid transferring stress on said mandrel due to the weight of said drill string to said housing and thus to said suspension device.

8. The apparatus of claim 7 wherein said fluid supplying means includes a flow coupling on said housing constructed and arranged so that said housing can rotate relative thereto as said housing is driven by said rotary.

* * * * *